US006443763B1

(12) United States Patent
Richet

(10) Patent No.: US 6,443,763 B1
(45) Date of Patent: Sep. 3, 2002

(54) TRIAXIAL CONTACT AND PROCESS FOR ASSEMBLING THE CONTACT

(75) Inventor: Daniel Richet, Les Mureaux (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/615,167

(22) Filed: Jul. 13, 2000

(30) Foreign Application Priority Data

Jul. 16, 1999 (FR) ..... 99 09291

(51) Int. Cl.[7] ..... H01R 9/05
(52) U.S. Cl. ..... 439/580; 439/607; 439/675
(58) Field of Search ..... 439/580, 578, 439/675, 607, 608, 609, 610

(56) References Cited

U.S. PATENT DOCUMENTS 4,307,926 A * 12/1981 Smith ..... 439/610
4,519,666 A * 5/1985 Williams et al. ..... 439/578
4,666,231 A 5/1987 Sheesley et al. ..... 439/581
4,674,809 A 6/1987 Hollyday et al. ..... 439/92
4,976,632 A * 12/1990 Riches et al. ..... 439/580

FOREIGN PATENT DOCUMENTS

EP 0299772 A2 1/1989
EP 0350835 A2 1/1990

* cited by examiner

*Primary Examiner*—Khiem Nguyen
*Assistant Examiner*—Michael C. Zarroli
(74) *Attorney, Agent, or Firm*—Perman & Green, LLP

(57) ABSTRACT

A triaxial contact (1) comprising three contacts (2, 3, 4) retained by a front insulator (5) which is anchored in a cavity (7) of a first cylindrical contact (2). A triaxial contact such that an intermediate contact (3) is harpooned inside a first receptacle of the front insulator. The front insulator is such that it has a second receptacle (30) allowing to accommodate and insulate the central contact. Said triaxial contact has a rear insulator (6) allowing to retain the intermediate contact and the central contact inside the cavity of the first contact.

12 Claims, 3 Drawing Sheets

TRIAXIAL CONTACT AND PROCESS FOR ASSEMBLING THE CONTACT

BACKGROUND OF THE INVENTION

1. Field of the Invention

The present invention relates to a triaxial contact. It also relates to a process for assembling such a triaxial contact. More particularly, it finds use in the field of parasitic-sensitive signal transmissions, especially in the field of telecommunications. A triaxial contact according to the invention may be used, for example, as an Ethernet cable connector. The invention also provides an easy process for assembling such contact.

2. Description of Prior Developments

In prior art, a triaxial contact comprises three contact elements. A first contact element, a cylindrical contact, has a cavity allowing to accommodate a second contact element, an intermediate contact, and a third contact element, a central contact, as well as insulating means. The insulating means are used to insulate contacts from each other. The intermediate contact typically has a socket at a first end, and a pin at a second end. The pin extends along a longitudinal axis of the socket, from a periphery of said socket. The central contact typically has a socket topped by a pin. This central contact is preferably placed in the central position, at the center of the first cylindrical contact, and at the center of the socket of the intermediate contact.

In order to insulate the three contacts from each other, a prior art triaxial contact, as shown in FIG. 1, has a first front insulator, on the right side of the figure. This first front insulator is interposed between an outer surface of the intermediate contact and an inner surface of the first cylindrical contact. The first front insulator is held in the cavity of the first contact by abutment against a release of the inner surface of the first contact. The intermediate contact is held inside the first front insulator by abutment against an inner shoulder of the first front insulator. The intermediate contact is housed in the first front insulator so that the socket is flush with a first side of the first cylindrical contact and that the pin projects out of a second side of the first cylindrical contact, the latter side being opposite to the former.

In order to electrically insulate the intermediate contact from the central contact, the triaxial contact has a second front insulator. The second front insulator especially covers an inner surface of the intermediate contact pin. The second front insulator is held inside the pin, by abutment against the periphery of the pin. The central contact is accommodated in a receptacle of the second front insulator, so that the central contact socket is also flush with the first side of the first cylindrical contact and that the pin of the central contact projects out of the second side.

In order to retain the central contact inside the receptacle of the second front insulator, a third rear insulator is force-fitted over the second front insulator. The third rear insulator allows the passage of the central contact pin, and of the intermediate contact pin, while insulating them from each other. An assembly is composed of the first front insulator, the intermediate contact, the second front insulator, the central contact and the third rear insulator. This assembly is retained inside the cavity of the first cylindrical contact on the one hand by abutment against the release of the inner surface and on the other hand, at the second side of the first contact, by an inwardly turned end of the cavity. Said end of the first contact is turned inwards after introducing the assembly inside the cavity. The turned end of the first cylindrical contact is then punched.

Considering that the intermediate contact is inserted in the first front insulator from a first side, that the second front insulator is inserted in the intermediate contact from the same side and that the central contact is also inserted in the second front insulator from the same side, then, in a certain sense, the assembly is only physically retained inside the first cylindrical contact by said punching. The stacking direction depends on the need to prevent removal of the intermediate contact when a complementary contact is connected. Then, the retention force is of about 50 daN. The different elements composing the triaxial contact are fitted one inside the other in the same fitting direction. Punching must be capable of resisting a pulling force simultaneously exerted on the intermediate contact and on the central contact pins.

A prior art triaxial contact involves a first problem, consisting in that such a triaxial contact includes individual front insulators, which are specific for each contact contained therein. Hence, a prior art triaxial contact having three contacts also has two front insulators. The provision of these two front insulators involves a first problem consisting in that each part is to be molded individually. Therefore, each front insulator has a specific shape which allows stacking thereof. The provision of separate molds is costly. Further, the provision of such number of parts requires a number of assembly steps. Also, the solidity of the assembly is only ensured by punching at an end of the first cylindrical contact. Such punching constitutes an additional step for assembling such a triaxial contact, and also requires special tools.

SUMMARY OF THE INVENTION

The invention has the object to obviate the above problems by providing a triaxial contact only comprising two insulators: a front and a rear insulator. The front insulator is used as the main insulator between the three contacts. Said first front insulator is accommodated inside a cavity of the first cylindrical contact. The front insulator further has a first receptacle to accommodate the intermediate contact and a second receptacle to accommodate the central contact. The two receptacles are separate, so that the intermediate contact is electrically insulated from the central contact. The rear insulator insulates the contacts from each other at an end of the first contact, a first socket of the intermediate contact and a second socket of the central contact projecting out of said end.

The arrangement of the invention first consists in providing parts which can be snapped into each other. A triaxial contact according to the invention does not require special assembly tools. In fact, the front insulator has harpoons which can be locked in a complementary receptacle provided on an inner wall of the first cylindrical contact, to form an elastic lock when the front insulator is fitted in the first cylindrical contact. Also, the intermediate contact is held inside the front insulator by a harpoon system provided on the intermediate contact, which is anchored in the front insulator upon assembly. The harpoon of the intermediate contact penetrates the insulator. On the other hand, the intermediate contact is inserted from a first side of the front insulator, whereas the central contact is inserted from a second side, the second side being opposite to the first side. The central contact is held in the rear insulator by a first abutment of the front insulator and by the rear insulator also abutting against an inner release of the first cylindrical contact. This lock is highly strong and the solidity of the assembly is naturally and effectively obtained with a single piece. Hence, the arrangement provided by the invention is less expensive, since it comprises a smaller number of insulating components, and the assembly of the different elements of a triaxial contact according to the invention is simpler and faster since the assembly process includes a smaller number of steps. The assembly can also stand a few disassembly operations, since the intermediate contact can be forcibly removed from the cylindrical contact.

Hence, the invention relates to a contact of the triaxial type, comprising a first outer cylindrical contact, an intermediate contact and a central contact, these contacts being held together by mechanical means and electrically insulated from each other by an insulating member, characterized in that the insulating member includes a single-piece front insulator, the front insulator being held at a front end of a cavity of the first cylindrical contact by means of a first elastic lock, secured in a first groove, the intermediate contact is held in a first receptacle of the front insulator by a harpoon embedded in the material of the front insulator, the central contact is situated in a second receptacle of the front insulator, and is locked therein by a shoulder of the front insulator.

The invention also relates to a process for assembling a triaxial contact including the following steps in the following order:

introducing an intermediate contact in a first receptacle of a front insulator from a front end of the front insulator, securing a harpoon of the intermediate contact in a wall of this first receptacle, introducing a central contact in a second receptacle of said front insulator from a rear end of said front insulator, said rear end being opposite to the front end of the front insulator, engaging a rear insulator against the rear end of the front insulator, the rear insulator and the rear end of the front insulator having an intermediate contact pin and a central contact pin projecting therefrom, introducing the assembly composed of the rear insulator, front insulator, intermediate and central contacts in a cavity of a cylindrical contact trough a front end of said cylindrical contact, locking said assembly against a step of the cylindrical contact by securing an elastic lock of the front insulator in a complementary groove of the cylindrical contact.

DESCRIPTION OF THE DRAWINGS

The invention will be understood more clearly by reading the following description and by analyzing the accompanying figures. The latter are only shown by way of example and do not intend to limit the invention in any manner. The figures show.

DESCRIPTION OF THE PREFERRED EMBODIMENTS

Figure 1:
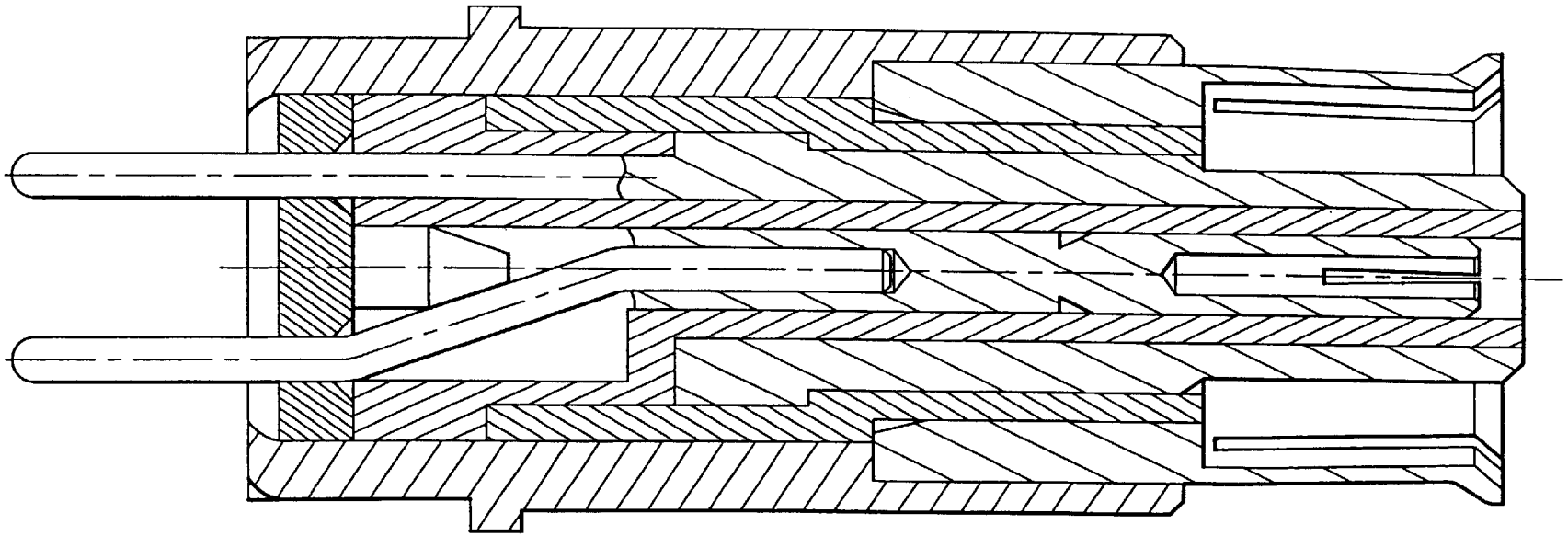
Fig. 1 PRIOR ART
FIG. 1: a longitudinal sectional view of a prior art triaxial contact.
Figure 2:
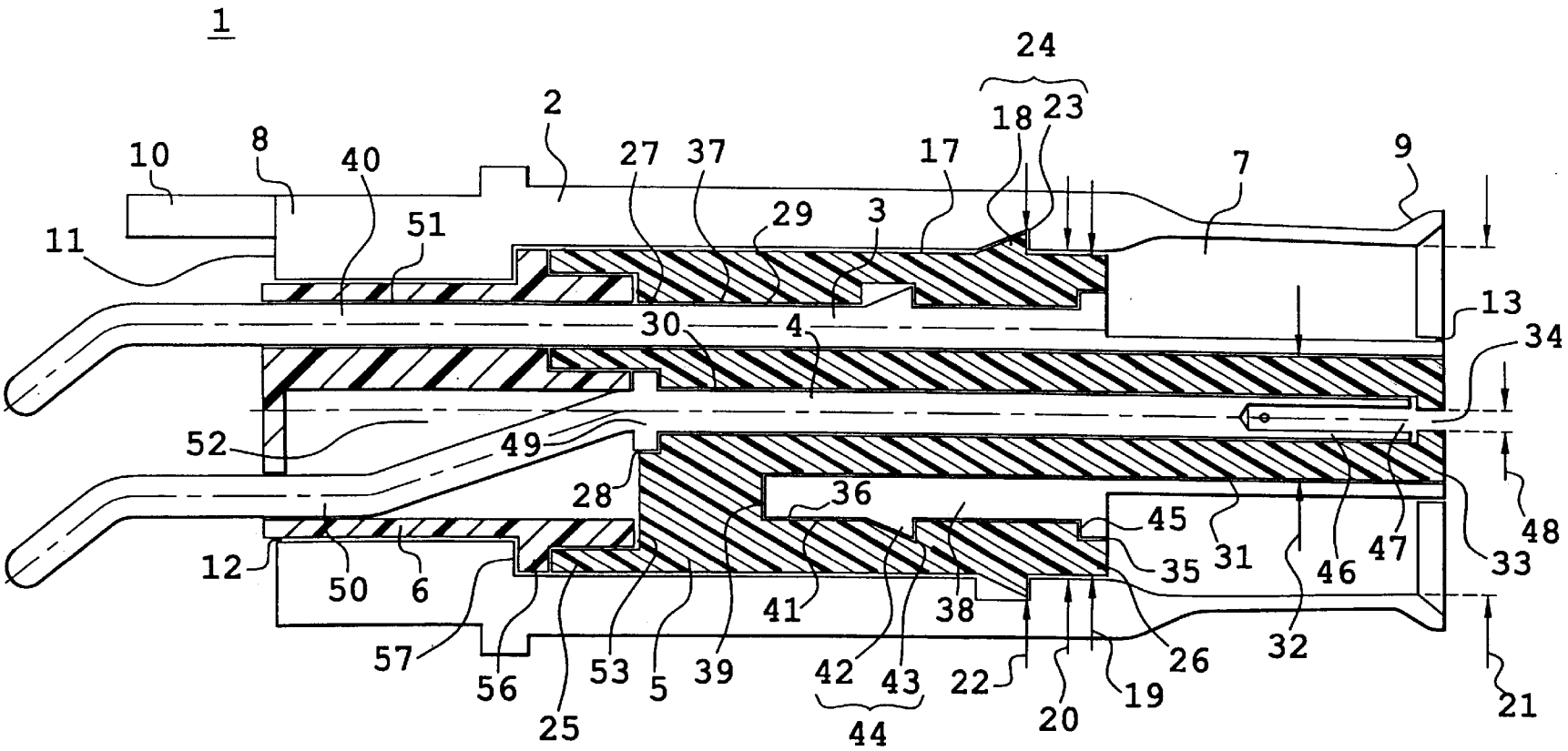
FIG. 2: a longitudinal sectional view of a triaxial contact according to the invention.
Figure 3:
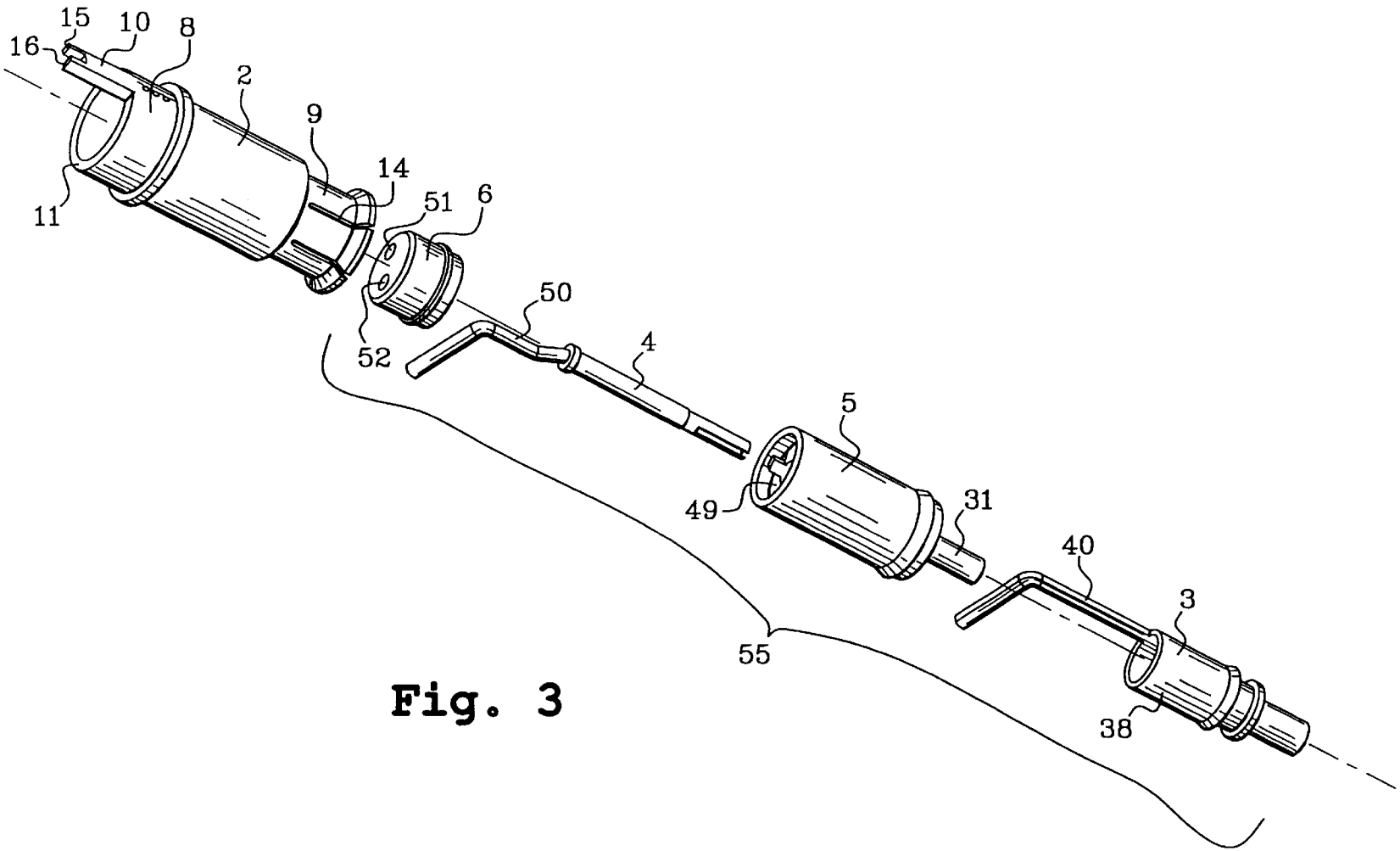
FIG. 3: an exploded view of the non assembled elements composing a triaxial contact according to the invention.

FIG. 2 shows a triaxial contact 1 according to the invention. The triaxial contact 1 includes a first contact 2, an intermediate contact 3 and a central contact 4. The triaxial contact 1 also includes a front insulator 5 and a rear insulator 6. The first contact 2 is a hollow cylindrical body. The first cylindrical contact 2 has a cavity 7. It particularly has a first rear end 8 and a second front end 9, delimiting the cavity 7. At the rear end 8, the first cylindrical contact 2 has an arm 10. The arm 10 stands perpendicularly at an edge 11 of an orifice 12 opening onto the cavity 7. In FIG. 2, the arm 10 has two teeth 15 and 16. Also, at the front end 9, the first cylindrical contact 2 has an orifice 13 opening onto the cavity 7. The front end 9 has slots 14, shown in FIG. 3. The slots 14 are oriented perpendicular to a plane formed by the orifice 13.

The front insulator 5 has a generally cylindrical shape. The front insulator 5 has a collar 18 on an outer wall 17. The collar 18 has a conical shape, one profile thereof being triangular. The collar 18 has a certain elasticity. The front insulator 5 has an outside diameter 19. The first cylindrical contact 2 has an inside diameter 20. The diameter 20 is slightly greater than the diameter 19. Also, the orifice 13 has a diameter 21. The diameter 21 is also greater than the outside diameter 19. So, the front insulator 5 may be introduced inside the cylindrical contact 2 from the front end 9, through the orifice 13. The front insulator introduced in the cavity 7, slides along the inner walls of the first cylindrical contact 2. In fact, the collar 18 has an inclined surface such that a diameter of the front insulator 5 is the greatest diameter 22 at the collar 18. The diameter 22 is also greater than the inside diameter 20. Therefore, when the front insulator is introduced in the cylindrical contact 2, the collar 18 is forced against the inner walls of the cylindrical contact 2. The front insulator 5 is force-fitted in the cavity 7 until the collar 18 engages in a groove 23 of the inner wall of the cylindrical contact 2. The groove 23 preferably has a rectangular profile. The collar 18 locked in the groove 23 forms a first elastic lock 24. In one variant, as shown in FIG. 2, the groove 23 may have a profile complementary to the profile of the collar 18.

In another variant of the invention, said first elastic lock 24 may consist of a collar provided on an inner wall of the cylindrical contact 2, and of a groove provided on an outer wall of the front insulator 5. In this case, the profile of the elastic lock is opposite to the one shown in FIG. 2. The part with the greater diameter of the collar is then situated on the rear end side 8. In this variant, the collar provided on the cylindrical contact 2 may be a harpoon, which could be embedded in the outer wall of the front insulator 5.

The front insulator 5 has a rear end 25 and a front end 26. The rear end 25 is on the same side as the rear end 8 of the cylindrical contact 2. Similarly, the front end 26 is on the same side as the front end 9 of the cylindrical contact 2. At the rear end 25, the front insulator 5 has a first opening 27 and a second opening 28. The openings 27 and 28 do not communicate with each other. The first opening 27 opens onto a first receptacle 29, and the second opening 28 opens onto a second receptacle 30. The second receptacle 30 is disposed at the center of the front insulator 5, and does not communicate anywhere with the receptacle 29. This allows to ensure insulation between the intermediate contact and the central contact.

At the end 26, the front insulator 5 has a central cylindrical extension 31. The central cylindrical extension 31 has an outside diameter 32. The outside diameter 32 is smaller than the diameter 19. The central cylindrical extension 31 has an orifice 34 at its end 33. The second receptacle 30 ends with the orifice 34. Also, at the second end 26, the front insulator 5 has a toric orifice 35. This toric orifice 35 encircles the central cylindrical extension 31. The toric orifice 35 communicates with the first receptacle 29.

The first receptacle 29 has a first toric cavity 36 allowing to accommodate a cylinder hollowed out at its center and such that the center of such hollowed-out cylinder may be traversed by the central cylindrical extension 31. Said toric cavity 36 opens onto a rectangular cavity 37. The rectangular cavity 37 in turn opens at the rear end 25 onto the first opening 27. The receptacle 29 is thus formed by the toric cavity 36 and the rectangular cavity 37.

The intermediate contact 3 has a cylindrical section 38 topped, on an edge 39 thereof, by a pin 40. The cylindrical section 38 has a shape complementary to the toric cavity 36. Further, the pin 40 has a rectangular shape complementary to the rectangular cavity 37. The intermediate contact 3 is introduced in the front insulator 5 from the front end 26 so that the central cylindrical extension 31 engages in the hollow of the cylindrical section 38, that said cylindrical section 38 engages by the toric orifice 35 in the toric cavity 36, and that the pin 40 engages in the rectangular cavity 37. The pin 40 projects out of the front insulator 5 through the first opening 27, at the rear end 25.

The cylindrical section 38 has a protrusion 42 on an outer surface 41. In a preferred embodiment of the invention, the protrusion 42 has a harpoon-like profile and is rigid. The harpoon 42 is anchored in a wall of the toric cavity 36, when it is introduced in the front insulator 5. Hence, the harpoon 42 is embedded in the material of the front insulator 5. Said anchorage allows a small number of assembling/disassembling operations. In one variant, the protrusion 42 may have a profile fit for engagement in a groove 43 provided on an inner face of the toric cavity 36. Here, the protrusion 42 is elastic. In this variant, it preferably has a conic shape and a triangular profile.

The protrusion 42 and the groove 43 may form an elastic lock 44. In a preferred example of this variant of the invention, the lock 44 has the same characteristics as the elastic lock 24. In another variant of the invention, the groove may be provided on the outer face of the intermediate contact 3, and the protrusion on an inner wall of the toric cavity 36. In this variant, the greater diameter of the protrusion is provided on the rear end side 25.

Therefore, the intermediate contact 3 is held inside the front insulator 5 by being retained by the elastic lock 44. Further, the intermediate contact 3 abuts against a front collar 45 of the orifice 35.

The central contact 4 also has a cylindrical shape. It particularly comprises a female socket 46. The central contact 4 is introduced in the front insulator 5 from the rear end 25 of the front insulator 5. The central contact 4 is thus introduced in the front insulator 5 from a side opposite to the side used for introducing the intermediate contact 3. Particularly, the female socket 46 is introduced through the second opening 28. The female socket 46 has an orifice 47 having an outside diameter slightly greater than an opening diameter 48 of the orifice 34. The orifice 34 thus allows to introduce a complementary connector for connection of the latter to the female socket 46. Also, the central contact 4 has a collar 49. Said collar 49 abuts against a rim of the second opening 28 of the front insulator 5. A pin 50 of the central contact 4 extends from the collar 49. The pin 50 is not accommodated in the front insulator 5.

The rear insulator 6 insulates the pin 40 from the pin 50 and both from the rear end 8 of the first contact 2. The rear insulator 6 has therefore a first tunnel 51 and a second tunnel 52. The pin 40 of the intermediate contact 3 passes through the first tunnel 51. The pin 50 of the central contact 4 passes through the second tunnel 52. The pin 50 is angled inside the second tunnel 52. The rear insulator 6 is mounted against the first end 25 of the front insulator 5. The rear insulator 6 abuts against an edge 5 of said first end 25. Once the rear insulator 6 has been mounted on the front insulator 5, the pin 40 and the pin 50 are bent. The pin 40 and the pin 50 are contacts to be welded. Therefore, in order to be more easily mounted on a printed circuit, such a triaxial contact includes two pins preferably turned in the same direction with respect to a main longitudinal axis of the contact, so that they can be thereafter welded on the same plane. Typically, the pins 40 and 50 are bent at an angle of 110° .

The front insulator 5, the rear insulator 6, the intermediate contact 3 and the central contact 4 form an assembly 55. This assembly 55 is introduced in the cavity 7 of the first cylindrical contact 2 from the front end 9 of said first contact 2. The assembly 55 is slid into the cavity 7, until the collar 18 engages in the groove 23 in such a manner as to mechanically lock it in place, and on the other hand until a side protrusion 56 of the rear insulator 6 abuts against a rim 57 of the inner wall of the first cylindrical contact 2.

The elastic lock 24 acts as a harpoon. In order to unlock a lock like the lock 24, a pulling force above 50 daN/mm$^2$ should be exerted on both parts of the lock. Also, the retaining force of the harpoon 42 anchored in the front insulator 5 is of the order of 50 daN. The resistance level of the lock and of the anchorage is definitely sufficient for the required use. In fact, a force exerted on one end of a contact contained in this type of contact is typically lower than 0,5 daN/mm$^2$.

What is claimed is:

1. A contact of the triaxial type, comprising a first outer cylindrical contact, an intermediate contact and a central contact, these contacts being held together by mechanical means and electrically insulated from each other by an insulating member, wherein the insulating member includes a single-piece front insulator, the front insulator being held at a front end of a cavity of the first cylindrical contact by means of a first elastic lock, secured in a first groove, the intermediate contact being held in a first receptacle of the front insulator by a harpoon embedded in the material of the front insulator, the central contact being situated in a second receptacle of the front insulator, and being locked therein by a shoulder of the front insulator, further wherein the elastic lock/s have a conical shape, such that a portion with the greater diameter of the conical shape is situated at the front end which is designed to receive the complementary connector.

2. A contact as claimed in claim 1 wherein said first groove is formed in an inner wall of said cavity of said first cylindrical contact.

3. A contact as claimed in claim 1, wherein said insulating member includes a rear insulator held by a rim at a rear end of said first cylindrical contact.

4. A contact as claimed in claim 3, wherein said rear insulator is traversed by a pin of said intermediate contact and by a pin of said central contact.

5. A contact as claimed in claim 4, wherein said two pins have a bend with respect to a longitudinal axis of said contact.

6. A contact as claimed in claim 1, wherein said central contact has a socket at its front end, and that said second receptacle has an orifice at the same front end, the orifice having a diameter slightly smaller than the inside diameter of the socket.

7. A process for assembling a triaxial contact including the steps of:

(a) introducing an intermediate contact in a first receptacle of a front insulator from a front end of the front insulator, (b) securing a harpoon of the intermediate contact in a wall of this first receptacle, (c) introducing a central contact in a second receptacle of said front insulator from a rear end of the front insulator, the rear end being opposite to the front end of the front insulator, (d) engaging a rear insulator against the rear end of the front insulator, the rear insulator and the rear end of the front insulator having an intermediate contact pin and a central contact pin projecting therefrom, (e) introducing the assembly composed of the rear insulator, front insulator, intermediate and central contacts in a cavity of a cylindrical contact trough a front end of the cylindrical contact, and (f) locking said assembly against a step of the cylindrical contact by securing an elastic lock of the front insulator in a complementary groove of the cylindrical contact.

8. A process as claimed in claim 7, further bending said intermediate contact pin which projects out of said rear insulator; and including the steps of:

bending said central contact pin projecting out of said rear insulator, preferably in the same direction as said intermediate contact pin.

9. A contact of the triaxial type, comprising a first outer cylindrical contact, an intermediate contact and a central contact, these contacts being held together by mechanical means and electrically insulated from each other by an insulating member, wherein the insulating member includes a single-piece front insulator, the front insulator being held at a front end of a cavity of the first cylindrical contact by means of a first elastic lock, secured in a first groove, the intermediate contact being held in a first receptacle of the front insulator by a harpoon embedded in the material of the front insulator, the central contact being situated in a second receptacle of the front insulator, and being locked therein by a shoulder of the front insulator, further wherein the insulating member includes a rear insulator held by a rim at a rear end of the first cylindrical contact.

10. A contact as claimed in claim 9, wherein said rear insulator is traversed by a pin of said intermediate contact and by a pin of said central contact.

11. A contact as claimed in claim 10 wherein the two pins have a bend with respect to a longitudinal axis of said contact.

12. A contact of the triaxial type, comprising a first outer cylindrical contact, an intermediate contact and a central contact, these contacts being held together by mechanical means and electrically insulated from each other by an insulating member, wherein the insulating member includes a single-piece front insulator, the front insulator being held at a front end of a cavity of the first cylindrical contact by means of a first elastic lock, secured in a first groove, the intermediate contact being held in a first receptacle of the front insulator by a harpoon embedded in the material of the front insulator, the central contact being situated in a second receptacle of the front insulator, and being locked therein by a shoulder of the front insulator, further wherein the central contact includes a socket at its front end, and that the second receptacle has an orifice at the same front end, the orifice having a diameter slightly smaller than the inside diameter of the socket.

* * * * *